US008002130B2

(12) United States Patent
Thilly

(10) Patent No.: US 8,002,130 B2
(45) Date of Patent: Aug. 23, 2011

(54) CLOSURE SYSTEM AND METHOD OF FILLING A VIAL

(75) Inventor: Jacques Thilly, Rixensart (BE)

(73) Assignee: Aseptic Technologies S.A. (BE)

( * ) Notice: Subject to any disclaimer, the term of this patent is extended or adjusted under 35 U.S.C. 154(b) by 794 days.

(21) Appl. No.: 11/913,996

(22) PCT Filed: May 15, 2006

(86) PCT No.: PCT/EP2006/004629

§ 371 (c)(1),
(2), (4) Date: Nov. 9, 2007

(87) PCT Pub. No.: WO2006/122757

PCT Pub. Date: Nov. 23, 2006

(65) Prior Publication Data

US 2009/0134114 A1 May 28, 2009

(30) Foreign Application Priority Data

May 17, 2005 (GB) ..... 0510057.3

(51) Int. Cl.

| | |
|---|---|
| ***B65D 51/20*** | (2006.01) |
| ***B65D 41/60*** | (2006.01) |
| ***A61J 1/05*** | (2006.01) |

(52) U.S. Cl. ..... 215/249; 215/253; 215/355; 604/415

(58) Field of Classification Search ..... 215/247, 215/249, 253, 355; 604/415

See application file for complete search history.

(56) References Cited

U.S. PATENT DOCUMENTS

| | | | | |
|---|---|---|---|---|
| 2,783,908 | A | 3/1957 | Winfield | |
| 3,815,771 | A * | 6/1974 | Marks | 215/344 |
| 4,243,150 | A | 1/1981 | Gunne et al. | |
| 4,275,511 | A | 6/1981 | Parkinson et al. | |
| 5,219,083 | A | 6/1993 | Liebert et al. | |
| 5,314,084 | A * | 5/1994 | Folta et al. | 215/249 |
| 5,421,469 | A * | 6/1995 | Lee | 215/274 |
| 5,718,348 | A * | 2/1998 | Manera | 215/249 |
| 6,604,561 | B2 | 8/2003 | Py | |
| 6,695,829 | B2 | 2/2004 | Hellstrom et al. | |
| 2002/0121496 | A1 * | 9/2002 | Thiebault et al. | 215/249 |

FOREIGN PATENT DOCUMENTS

| | | |
|---|---|---|
| DE | 40 11 878 | 10/1991 |
| EP | 0 832 822 | 4/1998 |
| GB | 450147 | 7/1936 |
| WO | WO 2005/014419 | 2/2005 |

OTHER PUBLICATIONS

Office action from the Patent Office of the Russian Federation in Application No. 2007115540/06(016882), which is a National Stage filing from PCT/EP2005/011623 by Thilly, 3 pp. (Jun. 11, 2009).

* cited by examiner

*Primary Examiner* — Anthony Stashick
*Assistant Examiner* — James N Smalley
(74) *Attorney, Agent, or Firm* — Klarquist Sparkman, LLP

(57) ABSTRACT

A closure system for a vial comprising: an elastic closure part to engage the mouth opening, a clamp part to hold the closure part in a closing relationship with the mouth opening, the clamp part defining an upper aperture through which a region of the upper surface of the closure part is exposed when the clamp part is engaged with the vial, a cover part to engage the clamp part to cover the exposed region, the cover part engaging with the closure part to provide two or more concentric ring-shaped seals, at least part of the cover part being removable from the vial to allow access to the closure.

16 Claims, 6 Drawing Sheets

50
45
72
43
44
54
40
32
42
56
14
41
31
12
11

CLOSURE SYSTEM AND METHOD OF FILLING A VIAL

CROSS-REFERENCE TO RELATED APPLICATIONS

This application a 371 of International Application Number PCT/EP2006/004629, filed 15 May 2006, which claims the benefit of GB Application No. 0510057.3, filed 17 May 2005.

This invention relates to a novel device, being a closure system for vials, particularly for pharmaceutical vials, for the sterile containment of drug substance or vaccine products therein.

BACKGROUND

Drug substance and vaccine products are frequently provided in vials which are closed with an elastomer closure part through which a hollow needle can be passed, puncturing the closure part, and via which the drug substance or vaccine product may be extracted for use, optionally after reconstitution by an aqueous medium introduced into the vial via the needle. U.S. Pat. No. 5,718,348, DE-A-1228,028 and FR-A-2598137 among others, disclose typical pharmaceutical vials and closures. WO-A-04/018317 discloses a vial closure comprising an elastomer closure part for the mouth opening capable of being punctured by a needle, a clamp part to hold the closure part in a closing relationship with the mouth opening and having an aperture therein through which the closure part is exposed, and a cover part to cover the aperture when so engaged.

The vial closure disclosed in WO-A-04/018317 is particularly suited to a known process e.g. from US-A-2002/0023409 in which the vial can be filled, under aseptic filling conditions, using a hollow needle passed through the closure part, the needle is then withdrawn, and the small residual puncture hole is then sealed by heat sealing, e.g. using a focused laser beam.

In use, a removable part of the cover part of the vial closure disclosed in WO-A-04/018317 is removed to expose the closure part through the aperture, and a needle may be passed through the closure to extract the contents for use, typically by injection, optionally after reconstitution.

BRIEF SUMMARY

It is important to ensure that the cover part keeps the outer surface of the closure sterile after filling and prior to removal of the removable part of the cover part, and it is an object of the present invention to address this problem.

It is also an object of this invention to provide an improved vial closure system having ease of construction, assembly and reduced loss of contents. Other objects and advantages of the present invention will be apparent from the following description.

According to this invention, a closure system is provided for a vial of the type having an upwardly-facing mouth opening bounded by a rim, the closure system comprising:

an elastic closure part shaped to sealingly engage with the mouth opening, having a lower surface facing the interior of the vial and an opposite upper surface facing away from the vial, and capable of being punctured by a needle, a clamp part able to engage with the vial, particularly with the rim of the mouth opening, and able to bear upon the closure part to hold the closure part in a closing relationship with the mouth opening, the clamp part defining an upper aperture through which a region of the upper surface of the closure part is exposed when the clamp part is engaged with the vial, a cover part, engageable with the clamp part and/or the vial to cover the said region of the closure part when so engaged, wherein the cover part engages with the upper surface of the closure part to provide two or more concentric ring-shaped seals which isolate a region of the upper surface of the closure within the innermost ring shaped seal from the environment, at least part of the cover part being removable from the vial to allow access to the closure.

"Upper" and "lower" herein is based on the normal configuration of the vial standing on its base with its mouth uppermost.

By "concentric" herein is included both ring shaped seals which have the same geometric centre, and also ring shaped seals which simply surround each other so that one ring shaped seal is wholly within the other.

By "ring-shaped" herein is included rings of any shape, preferably circular but alternatively oval or polygonal.

By "sterile" herein is included any reduced concentration of physiologically undesirable contaminants such as microorganisms, viruses etc. which complies with medicinal standards.

Vials for use with the closure of the invention may be made of glass, but preferably the vial is made of a hard plastic material accepted for use in the pharmaceutical industry. A suitable type of polymer is a cyclo-olefin copolymer ("COC"), a blend thereof or a blend thereof with another polymer. Examples of such COC polymers are for example disclosed in U.S. Pat. No. 5,723,189, EP-A-0436372 and EP-A-0556034 among others. A suitable hard plastic material accepted for use in the pharmaceutical industry is the cyclo-olefin copolymer "Topas" made by Celanese Corporation. For example the known COC polymers Topas 8007 or Topas 6015 may be used, available from for example Ticona GmbH (DE). Conditions for injection moulding this polymer to make vials therefrom are known in the art.

Typically the vial has a flange with a flat upper surface surrounding the rim of the mouth, and the clamp part bears upon the closure part to hold the closure part sealingly against the flat upper surface of the flange. Sealing of an elastomer closure part may be enhanced by an upward pointing sealing edge which locally compresses and digs into the elastomer.

The elastic closure part is suitably made of a material with rubbery characteristics e.g. soft and resiliently compressible. The closure part preferably has a downwardly extending plug part which fits into the mouth opening of the vial, and an outwardly extending peripheral flange part, a downward facing surface of which can engage with the upward facing surface of a rim of the vial mouth opening, particularly when this rim is in the form of a flange bounding the rim. Upwardly of such a flange part the closure part may be flat but is preferably upwardly convex, e.g. domed or of a (frustro) conical shape, and may have a flattened upper surface. The plug part is suitably of a hollow cylindrical shape with an upper end of the hollow cylindrical interior extending into this upper domed or conical part, e.g. such that the overall internal shape of the closure part is a bell- or dome-shape or a cylinder with an upper closed end of a domed or concave frustro-conical shape.

Preferably at least the upper surface of the closure part, preferably the whole of the closure part is made of a puncturable elastic material, so that to introduce liquid content into the container a hollow filling needle may be inserted through the closure part, liquid injected into the container through the needle, then the filling needle may be withdrawn. Such a procedure leaves a residual puncture hole through the elastomer material, which the inherent elasticity of such an elastic closure part will tend to close.

An advantage of the plural ring-shaped seals provided by the invention is that when the cover part is engaged, such a residual puncture hole can be located within the innermost seal, and the plural seals can effectively prevent environmental contamination from reaching the puncture hole. Optionally the elastic material may be a thermoplastic elastomer material, so that a puncture hole formed as a result of filling the vial using a hollow needle may be sealed by thermal sealing, e.g. using a focused light beam such as a laser as described in US-A-2002.0023409. A suitable thermoplastic elastomer may be based on styrenic block copolymer thermoplastic elastomers as commonly used for vial closures. A suitable thermoplastic elastomer material is a 50:50 w:w blend of the polymers "Engage" supplied by Dupont-Dow, and "Dynaflex" formerly known as "Kraton" as supplied by Shell but now available from GLS (USA) who supply this blend, and including a dye, e.g. grey in colour, to enhance absorption of laser light so that the thermoplastic elastomer material may be heated using laser light. A particularly preferred thermoplastic elastomer is that disclosed in WO-A-2005/014419. Under irradiation from a focused 980 nm laser this thermoplastic elastomer material easily fuses at ca. 180° C. and sets on cooling.

The clamp part is preferably made of a mouldable plastics material, preferably a resilient plastics material such as a polypropylene, polyamide etc. and is able to engage with the vial, preferably being engageable with the above-mentioned flange around the rim of the mouth opening of the vial, for example by a snap-fit engagement underneath a downwardly facing surface of such a flange part. The clamp part preferably comprises a lower skirt part able to engage with the vial, and is suitably also able to engage with the cover part. Suitably the clamp part comprises an upwardly extending skirt part able to engage with the cover part, and preferably such upper and lower skirt parts are integrally made. In such a construction the centre of the upwardly extending skirt part may comprise the upper aperture through which a region of the upper surface of the closure part is exposed when the clamp part is engaged with the vial. Preferably the clamp part is dimensioned so that when so engaged with the vial the clamp part can resiliently exert a compressive force upon the vial, e.g. the flange around the rim of the mouth opening and the closure part to compress them together and so to enhance sealing between the closure part and the vial.

The cover part is preferably also made of a mouldable plastics material, such as a polypropylene, polyamide etc. It is particularly preferred that the cover part is made of a plastics material which has a low permeability to water vapour, such as COC or a liquid crystal polymer, as some elastic materials used for closures are known to be permeable to water vapour. The cover part is preferably engageable with the clamp part. For example the cover part may be engageable by snap-fit means with the upwardly extending skirt part of the clamp part. For example the cover part may comprise a cap having an upper wall and a peripheral skirt wall, and the skirt wall of such a cap may have a snap-fit engagement part to engage with a corresponding engagement part of the clamp part, for example of the upwardly extending skirt part of the clamp part. Such snap-fit means may comprise a ridge on the cover part and a corresponding groove on the clamp part, or vice versa, or engaging beads. Other snap-fit means will be apparent to those skilled in the art and may be used. For example the peripheral skirt wall may fit telescopingly inside the upwardly extending skirt part of the clamp part.

The cover part covers the region of the closure part which is exposed through the aperture of the clamp part. The cover part preferably closes the aperture to also thereby cover the closure part. The cover part engages with the upper surface of the closure part to provide two or more concentric ring-shaped seals which isolate a region of the upper surface within the innermost ring shaped seal from the environment.

Suitably there may be two concentric ring-shaped seals. The ring-shaped seal is preferably provided by a compression seal achieved by relative pressure of a sealing part of the cover part against the relatively soft elastic material of the closure part.

It is preferred that the outermost of the plural ring-shaped seals is as close to the periphery of the closure part as is practical, because many elastic materials of the type used to make such closure parts are permeable to water vapour, which can lead to loss of water from an aqueous solution in the vial, or ingress of water to a dry e.g. lyophilised material in the vial. By locating the outermost of the plural ring-shaped seals close to the periphery of the closure part, and particularly if the cover part is made of one of the relatively water vapour-impermeable plastic materials referred to above, the cover part can isolate a substantial part of the outer surface of the closure part from the atmosphere and so reduce the passage of water vapour through the closure part.

Suitably such a sealing part is a sealing edge which engages with the closure part to form an enclosure bounded by the cover part, the closure and the sealing part. This enclosure is isolated from the environment so ingress of contamination is restricted or ideally completely prevented by such a seal.

The plural sealing parts may be provided on the underside of the upper wall; or on the peripheral skirt wall of a cover part of the type described above; or on both the underside of the upper wall and on the peripheral skirt wall. For the reasons above, to position the outermost of the plural ring-shaped seals close to the periphery of the closure part, it is preferred that the outermost sealing part is located adjacent to the lower rim of the descending peripheral skirt of the above-described cover part. For example there may be an inner sealing part on the underside of the upper wall and an outer concentric sealing part adjacent the lower rim of the peripheral skirt wall.

The upper wall of a cover part as described above may have a first, inner, sealing part comprising a downward pointing sealing ridge. Such a sealing ridge suitably has a sealing edge which preferably has a generally triangular section as cut parallel to the up-down direction, so that the sealing edge comprises the apex of the triangle. The sealing edge preferably follows a ring-shaped, e.g. circular, oval or polygonal closed perimeter as viewed looking upwardly toward the lower surface of the upper wall of the cover part. This sealing ridge may be formed on the lower surface of the upper wall of the cover part to contact and locally compress the closure to form a seal.

On the upper wall of such a cover part there may be a second, outer, concentric, sealing part comprising a similar downward pointing sealing ridge.

Alternatively there may be a second outer sealing part comprising an inward pointing ridge on the inner surface of the peripheral skirt part, particularly adjacent its lower rim, also to contact and locally compress the closure to form a seal.

At least part of, preferably all of the cover part is removable from the vial to allow access to the closure. Preferably the cover part is removable from the clamp part. Alternatively part of the cover part, e.g. a tear-off portion, e.g. connected to the remainder of the cover part by integral thin frangible links, is removable from the remainder. Alternatively the cover part may be engaged with a first part of the clamp part and a second part of the clamp part is engaged to the vial, and the first part of the clamp part is removable from the second part, the cover part being thereby removable from the vial, e.g. together with the removed first part of the clamp part. In an embodiment of this the cover part is engageable with a first part comprising the upwardly extending skirt part of the clamp part, and the second part comprises the lower skirt part, and the upwardly extending skirt part are removably connected, e.g. by thin integral frangible links.

The present invention further provides a vial when fitted with a closure system as described herein.

It is preferred to assemble the assembly of vial, closure part, clamp part and cover part with all of these parts in a sterile state, e.g. radiation pre-sterilised, and to perform the assembly operation under sterile, e.g. aseptic conditions.

The present invention also provides a method of enclosing a liquid material in a vial as described above, comprising the steps of (1) providing a vial which has its mouth closed with an elastic closure part shaped to sealingly engage with the mouth opening, having a lower surface facing the interior of the vial and an opposite upper surface facing away from the vial, and capable of being punctured by a needle, and having a clamp part engaging with the vial, particularly with the rim of the mouth opening, and bearing upon the closure part to hold the closure part in a closing relationship with the mouth opening, the clamp part defining an upper aperture through which a region of the upper surface of the closure part is exposed when the clamp part is engaged with the vial, the vial having a sterile interior, (2) introducing a liquid into the vial under sterile conditions (e.g. by the known method of using a downward laminar flow of air) by inserting a hollow needle through the closure, passing a liquid into the vial via the needle, then removing the needle from the closure, (3) engaging a cover part with the clamp part and/or the vial to cover the said region of the closure part when so engaged, wherein the cover part engages with the upper surface of the closure part to provide two or more concentric ring-shaped seals which isolate a region of the upper surface of the closure within the innermost ring shaped seal from the environment, at least part of the cover part and/or cover part being removable from the vial to allow access to the closure.

Between steps (2) and (3) above there may be the step of optionally sealing the residual puncture hole left by the needle, preferably by heat, preferably by a laser beam. However the seal provided by the plural ring-shaped seals of the invention may be sufficient that such heat sealing may be unnecessary.

The invention will now be illustrated by way of example only with reference to the following drawings.

DETAILED DESCRIPTION

Figure 1:
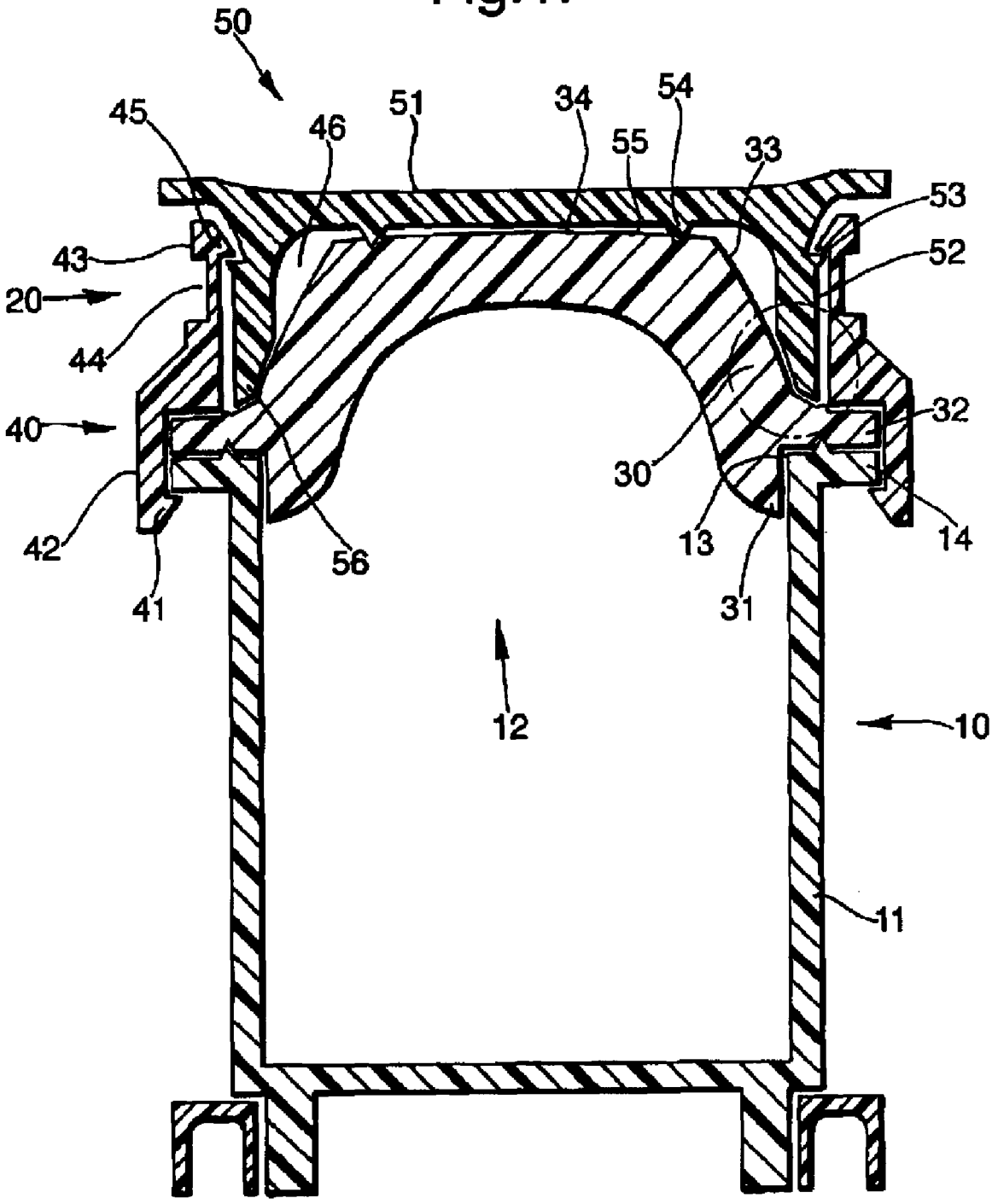
FIG. 1 shows a longitudinal section of a vial and vial closure system according to this invention cut along an up-down plane.

10 vial
11 cylindrical body
12 upwardly-facing mouth opening
13 rim
14 flange
20 closure system generally
30 elastic closure part generally
31 downwardly extending plug part
32 outwardly extending peripheral flange part
33 upwardly domed part
34 flattened upper surface
40 clamp part generally
41 teeth
42 lower skirt part
43 upwardly extending skirt part
44 thin links
45 bead
50 cover part generally
51 upper wall
52 descending peripheral skirt
53 bead
54 sealing ridge
55 enclosure
56 ridge
57 aperture
60 cover part
61,62 two ring-shaped sealing edges
63 part which is removable
64 frangible links
70 filling needle
71 liquid content
72 puncture hole In FIG. 1 for clarity small clearances between actually contacting parts are shown.

Referring to FIG. 1, a vial 10 generally is of the type having a cylindrical body 11, an upwardly-facing mouth opening 12 bounded by a rim 13 in the form of a flange 14 with an upward facing surface. Vial 10 is made of a hard plastic material being the cycloolefin copolymer known as "Topas" available from for example Ticona GmbH (DE).

The mouth 12 of vial 10 is closed by a closure system 20 generally. Closure 20 comprises an elastic closure part 30 shaped to sealingly engage with the mouth opening 12. Closure 30 has a downwardly extending plug part 31 which fits into the mouth opening 12 of the vial 10, and an outwardly extending peripheral flange part 32, a downward facing surface of which can engage with the upward facing surface of flange 14 of vial mouth opening 12, a tight seal being encouraged by a ring shaped sealing edge on the upward facing surface of the flange 14. Upwardly of the flange part 32 the closure part 20 has an upwardly domed part 33 with a flattened upper surface 34. Closure part 30 is made of a known thermoplastic elastomer material, so that a puncture hole formed as a result of filling the vial using a hollow needle may be sealed by thermal sealing.

Closure part 30 is held in place on flange 14 by means of clamp part 40 which engages with the rim 13 of the mouth opening 12, and bears upon the upper surface of flange part 32 of the closure part 30 to hold the closure part 30 in a closing relationship with the mouth opening 12, the seal between the closure part 30 and the flange being enhanced by an upward pointing sealing edge on the upper surface of the flange.

Clamp part 40 is made of a mouldable resilient plastics material and engages with the flange 14 around the rim 13 of the mouth opening 12 of vial 10 by a snap-fit engagement of teeth 41 underneath the flange of the rim 13. Clamp part 40 comprises a lower skirt part 42 which engages with the flange 14 of vial 10, and also an integral upwardly extending skirt part 43, linked to lower skirt part 42 by plural thin frangible links 44. Skirt part 43 is tubular and defines a central aperture, through which a region of the upper surface 34 of the closure part 30 is exposed when the clamp part 40 is engaged with the vial 10. Clamp part 40 is dimensioned so that when so engaged with the vial 10 as shown the clamp part 40 resiliently compresses flange 14 and flange part 32 of the closure part 30 together and so to enhance sealing between the closure part 30 and the vial 10.

A cover part 50 is shown engaged with clamp part 40. Cover part 50 is made of a resilient mouldable plastics material. Cover part 50 comprises an upper wall 51 and a descending peripheral skirt 52. Skirt 52 fits telescopingly within skirt 43 of clamp part 40, and on the outer surface of skirt 52 is a bead 53 which snap-fit engages with a corresponding bead 45 on the inner surface of skirt 43. When in place as shown cover part 50 closes the upper opening of the central aperture 46 of skirt 43, and covers the region of the upper surface 34 of closure part 30 which is exposed through this aperture 46 of the clamp part 40.

On the underside of the upper wall 51 is a downward pointing sealing ridge 54 with a sealing edge of a generally triangular section as cut parallel to the up-down direction, so that the sealing edge comprises the apex of the triangle. Sealing ridge 54 follows a perimeter which is circular in a horizontal plane perpendicular to the drawing. With the cover part 50 in place as shown, the snap fit engagement of clamp part 40 and cover part 50 urges the ridge 54 into contact with surface 34 to locally compress the closure 20 to form a seal, thus forming an enclosure 55 bounded by the upper wall 51 of cover part 50, the closure 30 and the sealing ridge 54 which is isolated from the environment so that ingress of contamination to the enclosed part of the upper surface 34 is restricted or ideally completely prevented.

Adjacent the lower rim of skirt 52 of cover part 50 is an inward pointing ridge 56 on the inner surface of the skirt part 52. With the cover part 50 in place as shown, the snap fit engagement of clamp part 40 and cover part 50 urges the ridge 56 into contact with and to locally compress the outer surface of domed part 33 of closure 30 to form a seal. Clearance between ridge 56 and closure part 30 is shown in the drawings, but in fact the edge 56 digs into the elastomer material of closure part 30.

The two seals so-formed are concentric ring-shaped seals which isolate a region of the upper surface 34 of the closure 30 within the innermost ring shaped seal 54 from the environment. It is seen that virtually all of the upper part 33 of the closure part 30 is covered by the cover part 50. If the cover part 50 is made of a relatively water vapour-impermeable plastic material then this covering can help to reduce passage of water vapour through the elastic material of closure part 30.

The cover part 50 is removable from the vial 10 to allow access to the closure as follows. If a pulling force is applied to the part 51 of cover part 50, the integral thin links 44 are severed, and the cover part 50 and the upper skirt 43 are removable from the remainder of the clamp part 40 and the vial 10 to thereby allow access to the closure 30.

Figure 1A:
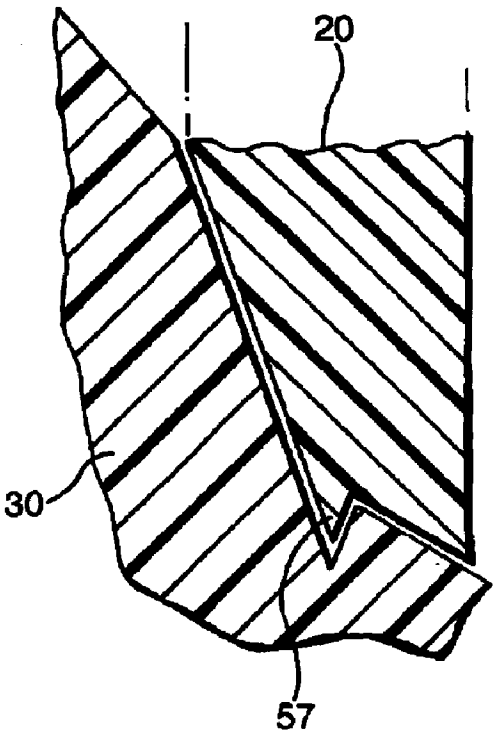

FIG. 1A shows in enlarged detail an alternative construction of the region circled in FIG. 1, showing the interface between the closure part 30 and the cover part 20. In FIG. 1A a downward-pointing ring-shaped sealing edge 57 is integrally provided around the lower rim of the skirt part 52 of cover part 50. As with the inward pointing edge 56 the edge 57 can dig into the soft surface of closure part 30 and provide a seal.

Figure 2:
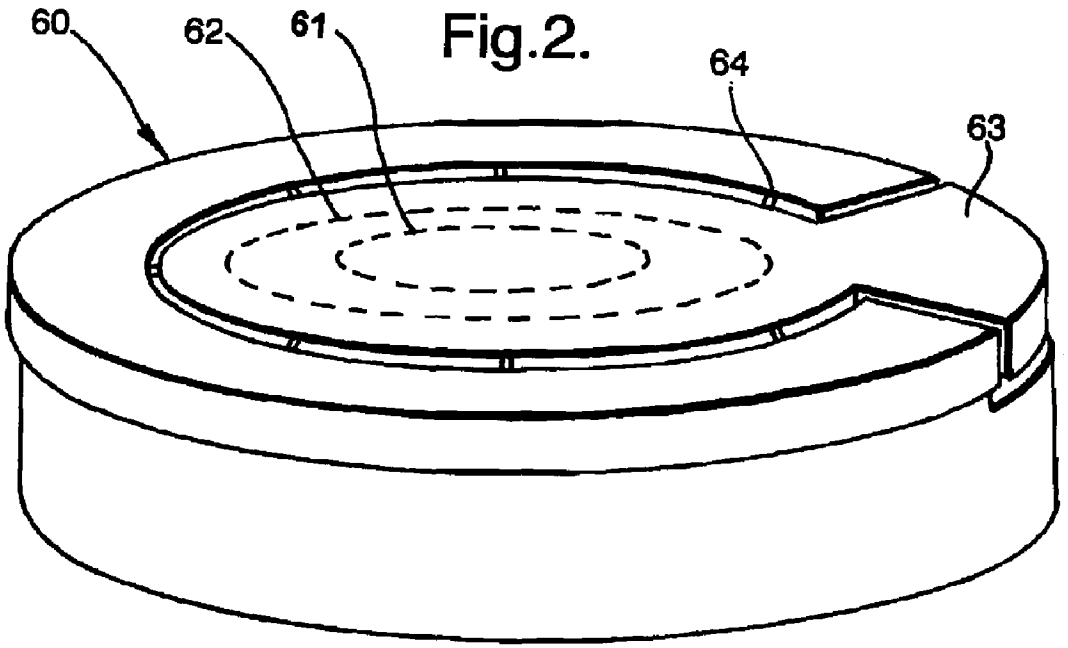
FIGS. 2-5 show a vial filling process using the vial closure system of this invention.

FIG. 2 illustrates adaptation of the present invention to the closure system of a vial of the type specifically disclosed in WO 2004/018317. FIG. 2 shows a perspective view of a cover part 60 having a construction shown in FIG. 2 of WO 2004/018317 as numbered 40 in WO 2004/018317. In FIG. 2 the position of two ring-shaped sealing edges 61, 62 of similar construction to the single ring-shaped sealing edge 44 of FIG. 2 of WO 2004/018317 is shown in dotted outline. A part 63 (corresponds to part 46 shown in FIG. 2 of WO 2004/018317) of the cover part 60, including the two ring-shaped edges 61,62 is removable from the remainder of the cover part 60 in a manner analogous to that 46 of FIG. 2 of WO 2004/018317, by severance of the frangible links 64. The two ring-shaped seals 61, 62 locally compress an elastomeric closure of the type 20 shown in WO 2004/018317.

Figure 3:
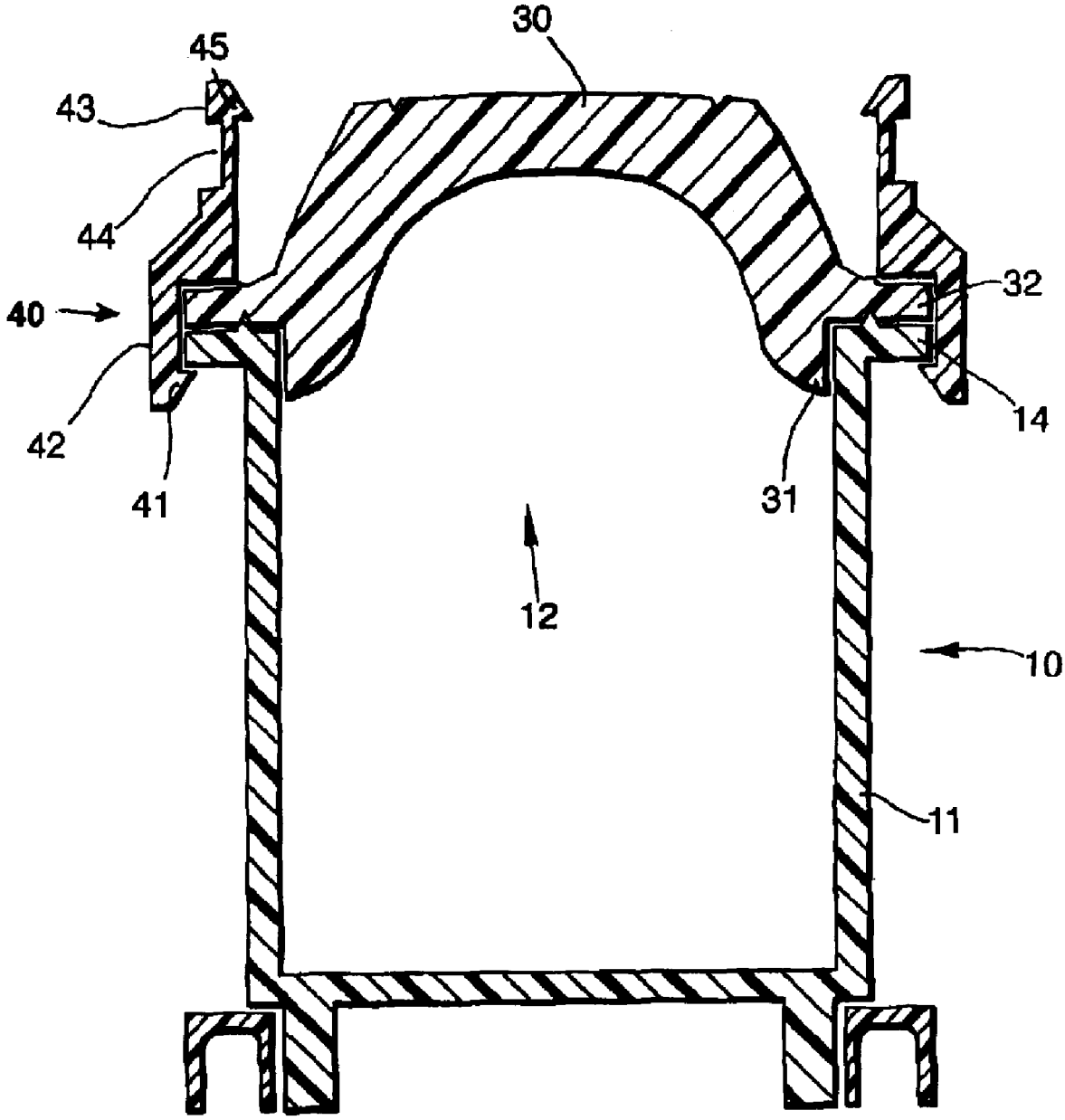
Figure 4:
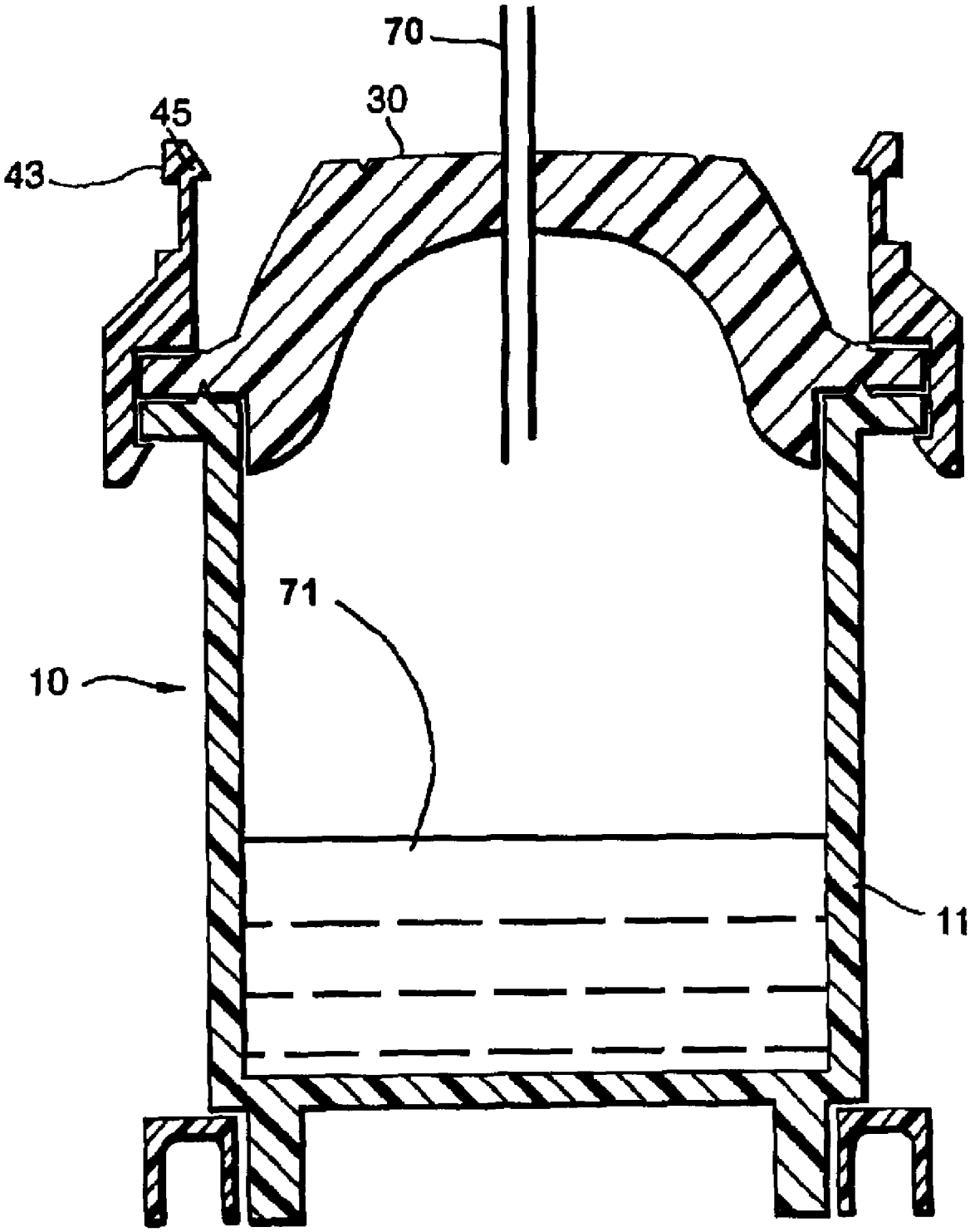
Figure 5:
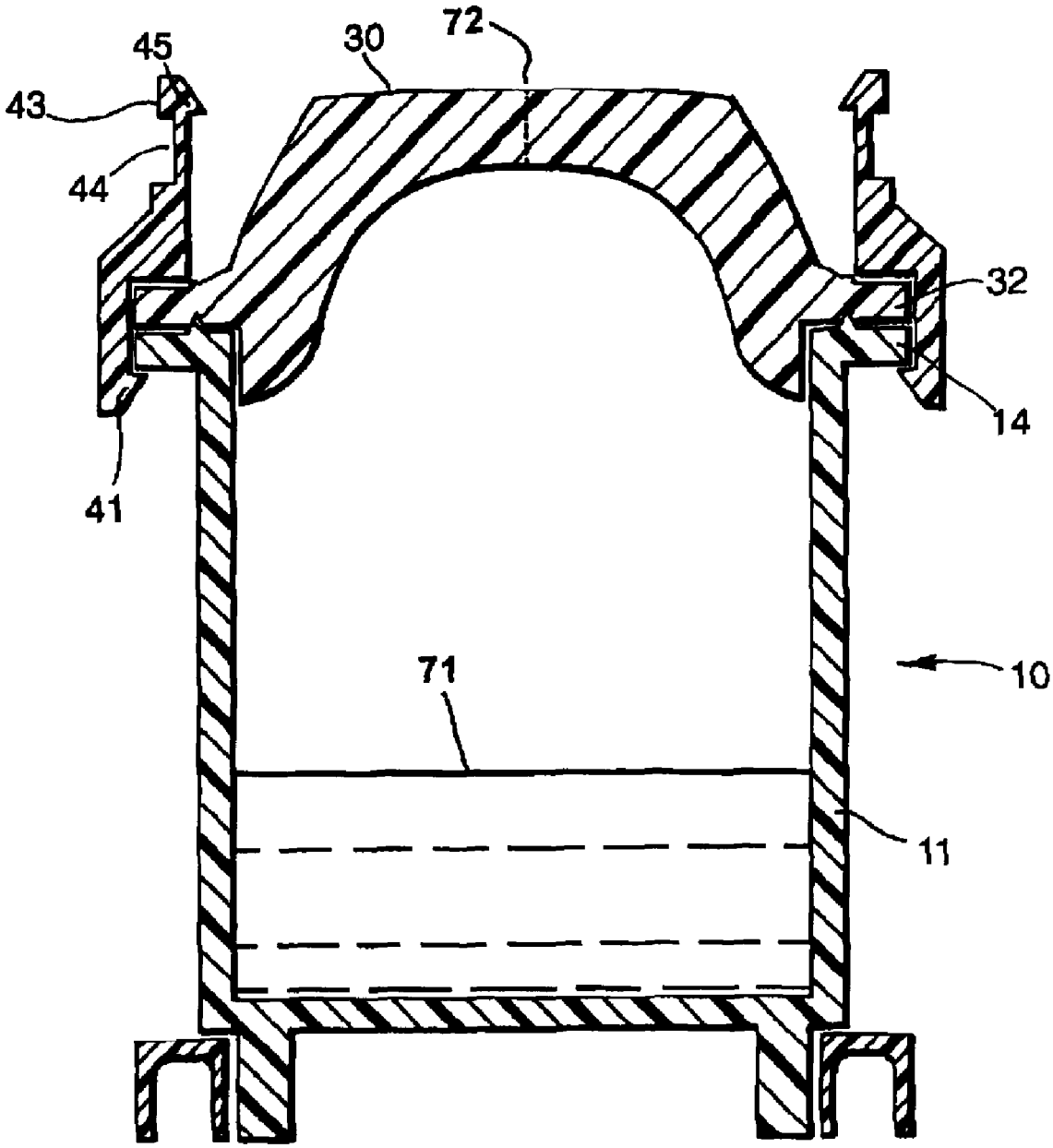

FIGS. 3-6 illustrate a vial filling process using such a vial 10 and closure system 20. In FIG. 3 a vial 10 assembled with the closure part 30 and clamp part 40 is shown, the parts 10, 30, 40 having been pre-sterilised and their assembly being under aseptic conditions. In FIG. 4, under aseptic conditions, a filling needle 70 is passed through the upper part 33 of closure part 30 and liquid content 71 is injected via needle 70 into the vial 10, displaced air escaping through a groove (not shown) in the outer surface of needle 70. In FIG. 5 the needle 70 has been withdrawn, leaving a residual puncture hole 70 through the closure 30. The resilience of the elastic material of closure part 30 causes the sides of the puncture hole 72 to come together and seal the hole 72. Optionally residual hole 72 can be heat sealed e.g. with a focused laser beam.

Figure 6:
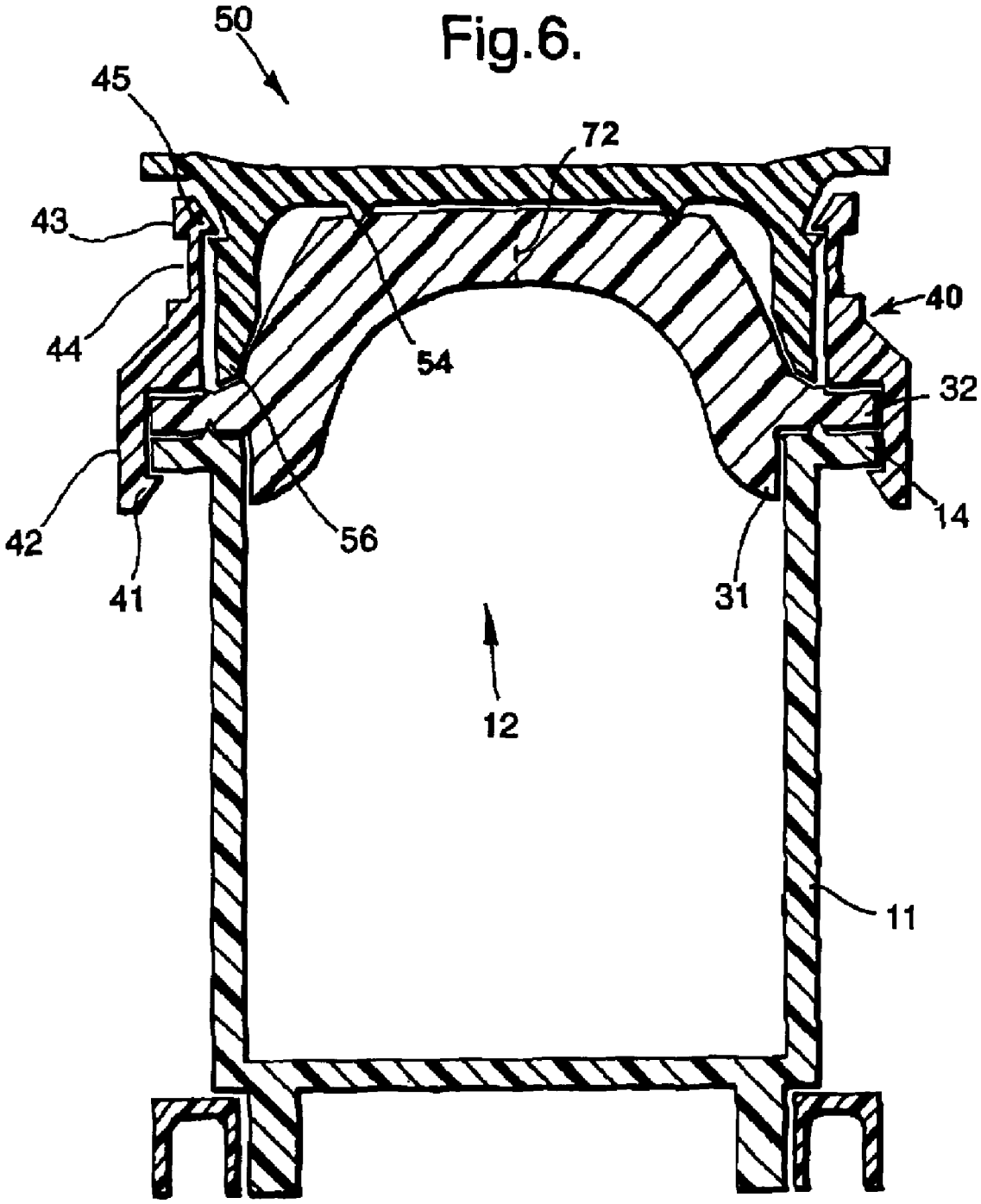

In FIG. 6, still under aseptic conditions, the cover part 50 has been snap-fitted onto clamp part 40, and it is seen that the puncture hole 72 is surrounded concentrically by the two seals 54,56. The seal provided by the two concentric ring-shaped seals 54,56, 54,57, or 61,62 may be sufficiently secure against the outside environment that such heat sealing is unnecessary.

The invention claimed is:

1. A closure system for a vial of the type having an upwardly-facing mouth opening bounded by a rim, the closure system comprising:

an elastic closure part shaped to sealingly engage with the mouth opening, having a lower surface facing the interior of the vial and an opposite upper surface facing away from the vial, and capable of being punctured by a needle, wherein the closure part has a downwardly extending plug part which fits into the mouth opening of the vial, and an outwardly extending peripheral flange part, a downward facing surface of which can engage with the upward facing surface of a rim of the vial mouth opening, and upwardly of the flange part of the closure part is upwardly convex;

a clamp part able to engage with the vial, and able to bear upon the closure part to hold the closure part in a closing relationship with the mouth opening, the clamp part defining an upper aperture through which a region of the upper surface of the closure part is exposed when the clamp part is engaged with the vial, a cover part, engageable with the clamp part and/or the vial after the clamp part has engaged the vial and borne upon the closure part to cover the said region of the closure part when so engaged, wherein the cover part engages with the upper surface of the closure part to provide two or more concentric ring-shaped seals which isolate a region of the upper surface of the closure within the innermost ring shaped seal from the environment, at least part of the cover being removable from the vial to allow access to the closure.

2. Closure system according to claim 1 wherein the closure part is made of a thermoplastic elastomer material, so that a puncture hole formed as a result of filling the vial using a hollow needle may be sealed by thermal sealing.

3. Closure system according to claim 1, wherein the clamp part is made of a mouldable resilient plastics material and comprises a lower skirt part able to engage with the vial, and also able to engage with the closure part, and the clamp part comprises an upwardly extending skirt part able to engage with the cover part.

4. Closure system according to claim 3 wherein the centre of the upwardly extending skirt part comprises the upper aperture through which a region of the upper surface of the closure part is exposed when the clamp part is engaged with the vial.

5. Closure system according to claim 3 wherein the cover part is engageable by snap-fit means with the upwardly extending skirt part of the clamp part.

6. A closure system for a vial of the type having an upwardly-facing mouth opening bounded by a rim, the closure system comprising:

an elastic closure part shaped to sealingly engage with the mouth opening, having a lower surface facing the interior of the vial and an opposite upper surface facing away from the vial, and capable of being punctured by a needle, a clamp part able to engage with the vial, and able to bear upon the closure part to hold the closure part in a closing relationship with the mouth opening, wherein the clamp part is made of a mouldable resilient plastics material and comprises a lower skirt part able to engage with the vial, and also able to engage with the closure part, and the clamp part comprises an upwardly extending skirt part able to engage with the cover part, the clamp part defining an upper aperture through which a region of the upper surface of the closure part is exposed when the clamp part is engaged with the vial, a cover part, engageable with the clamp part and/or the vial after the clamp part has engaged the vial and borne upon the closure part to cover the said region of the closure part when so engaged, wherein the centre of the upwardly extending skirt part comprises the upper aperture through which a region of the upper surface of the closure part is exposed when the clamp part is engaged with the vial, wherein the cover part engages with the upper surface of the closure part to provide two or more concentric ring-shaped seals which isolate a region of the upper surface of the closure within the innermost ring shaped seal from the environment, wherein the cover part further comprises a cap having an upper wall and a peripheral skirt wall, and the skirt wall has a snap-fit engagement part to engage with a corresponding engagement part of the clamp part, at least part of the cover being removable from the vial to allow access to the closure.

7. Closure system according to claim 6 wherein the skirt wall of the cover part snap-fit engages with the upwardly extending skirt part of the clamp part.

8. Closure system according to claim 1 wherein the ring-shaped seals are provided by a compression seal achieved by relative pressure of a sealing part of the cover part against the elastic material of the closure part.

9. Closure system according to claim 8 wherein the sealing part is a sealing edge which engages with the closure part to form an enclosure bounded by the cover part, the closure and the sealing part.

10. A closure system for a vial of the type having an upwardly-facing mouth opening bounded by a rim, the closure system comprising:

an elastic closure part shaped to sealingly engage with the mouth opening, having a lower surface facing the interior of the vial and an opposite upper surface facing away from the vial, and capable of being punctured by a needle, a clamp part able to engage with the vial, and able to bear upon the closure part to hold the closure part in a closing relationship with the mouth opening, the clamp part defining an upper aperture through which a region of the upper surface of the closure part is exposed when the clamp part is engaged with the vial, a cover part, engageable with the clamp part and/or the vial after the clamp part has engaged the vial and borne upon the closure part to cover the said region of the closure part when so engaged, wherein the cover part engages with the upper surface of the closure part to provide two or more concentric ring-shaped seals which isolate a region of the upper surface of the closure within the innermost ring shaped seal from the environment, wherein the ring-shaped seals are provided by a compression seal achieved by relative pressure of a sealing part of the cover part against the elastic material of the closure part, and wherein there is an inner sealing part on the underside of an upper wall of the cover part and an outer concentric sealing part on the peripheral skirt wall of the cover part, at least part of the cover being removable from the vial to allow access to the closure.

11. Closure system according to claim 10 wherein the outer concentric sealing part is adjacent the lower rim of the peripheral skirt wall.

12. Closure system according to claim 10 wherein the upper wall of a cover part has a first, inner, sealing part comprising a downward pointing sealing ridge, and a second outer sealing part.

13. A closure system for a vial of the type having an upwardly-facing mouth opening bounded by a rim, the closure system comprising:

an elastic closure part shaped to sealingly engage with the mouth opening, having a lower surface facing the interior of the vial and an opposite upper surface facing away from the vial, and capable of being punctured by a needle, a clamp part able to engage with the vial, and able to bear upon the closure part to hold the closure part in a closing relationship with the mouth opening, the clamp part defining an upper aperture through which a region of the upper surface of the closure part is exposed when the clamp part is engaged with the vial, a cover part, engageable with the clamp part and/or the vial after the clamp part has engaged the vial and borne upon the closure part to cover the said region of the closure part when so engaged, wherein the cover part engages with the upper surface of the closure part to provide two or more concentric ring-shaped seals which isolate a region of the upper surface of the closure within the innermost ring shaped seal from the environment, at least part of the cover being removable from the vial to allow access to the closure, and further wherein the cover part is engaged with a first part of the clamp part and a second part of the clamp part is engaged to the vial, and the first part of the clamp part is removable from the second part of the clamp part, the cover part being thereby removable from the vial with the removed part of the clamp part.

14. Closure system according to claim 13 wherein the cover part is engageable with the first part of the clamp part comprising an upwardly extending skirt part of the clamp part, wherein the second part of the clamp part comprises a lower skirt part, and wherein the upwardly extending skirt part of the clamp part and the lower skirt part of the clamp part are removably connected by thin integral frangible links.

15. A method of enclosing a liquid material in a vial, comprising the steps of (1) providing a vial which has its mouth closed with an elastic closure part shaped to sealingly engaged with the mouth opening, having a lower surface facing the interior of the vial and an opposite upper surface racing away from the vial, and capable of being punctured by a needle, and having a clamp part engaging with the vial, particularly with the rim of the mouth opening, and bearing upon the upper surface of the closure part to hold the closure part in a closing relationship with the mouth opening, the clamp part defining an upper aperture through which a region of the upper surface of the closure part is exposed when the clamp part is engaged with the vial, the vial having a sterile interior, (2) introducing a liquid into the vial under sterile conditions by inserting a hollow needle through the closure, passing a liquid into the vial via the needle, then removing the needle from the closure, (3) engaging a cover part with the clamp part and/or the vial to cover the said region of the closure part when so engaged, wherein the cover part engages with the upper surface of the closure part to provide two or more concentric ring-shaped seals which isolate a region of the upper surface of the closure within the innermost ring shaped seal from the environment, at least part of the cover part and/or cover part being removable from the vial to allow access to the closure.

16. A method according to claim 15 characterised in that between steps (2) and (3) there is the step of sealing the residual puncture hole left by the needle.

* * * * *